US005383258A

United States Patent [19]

Nicoletti

[11] Patent Number: 5,383,258

[45] Date of Patent: Jan. 24, 1995

[54] SKI-BOOT FASTENING WITH A DEVICE FOR ADJUSTING THE FASTENING TENSION

[75] Inventor: Graziano Nicoletti, Treviso, Italy

[73] Assignee: Canstar Italia S.p.A., Treviso, Italy

[21] Appl. No.: 71,628

[22] Filed: Jun. 3, 1993

[30] Foreign Application Priority Data

Aug. 13, 1992 [IT] Italy ..... MI92U000785

[51] Int. Cl.[6] ..... A43C 11/14

[52] U.S. Cl. ..... 24/68 SK; 24/70 SK; 24/71 SK

[58] Field of Search ..... 24/68 R, 68 SK, 69 SK, 24/70 SK, 71 SK

[56] References Cited

U.S. PATENT DOCUMENTS

| | | | |
|---|---|---|---|
| 3,173,182 | 3/1965 | Teufel | 24/68 SK |
| 4,051,611 | 10/1977 | Chalmers | 24/68 SK X |
| 4,470,175 | 9/1984 | Chiarella | 24/70 SK |
| 4,541,147 | 9/1985 | Olivieri | 24/68 SK |
| 4,553,292 | 11/1985 | Pradier et al. | 24/71 SK X |
| 4,651,392 | 3/1987 | Olivieri | 24/68 SK X |
| 4,893,384 | 1/1990 | Bidoia et al. | 24/68 SK |

FOREIGN PATENT DOCUMENTS

| | | | |
|---|---|---|---|
| 401202 | 12/1990 | European Pat. Off. | 24/69 SK |
| 130715 | 12/1928 | Switzerland | 24/68 SK |

*Primary Examiner*—James R. Bittain

*Attorney, Agent, or Firm*—Robbins, Berliner & Carson

[57] ABSTRACT

The ski-boot fastening described has a device for adjusting the fastening tension, in which a slide operated by male-and-female screw means supports the pin which connects the engagement element to the tensioning lever of the fastening.

4 Claims, 3 Drawing Sheets

SKI-BOOT FASTENING WITH A DEVICE FOR ADJUSTING THE FASTENING TENSION

Figure 1:
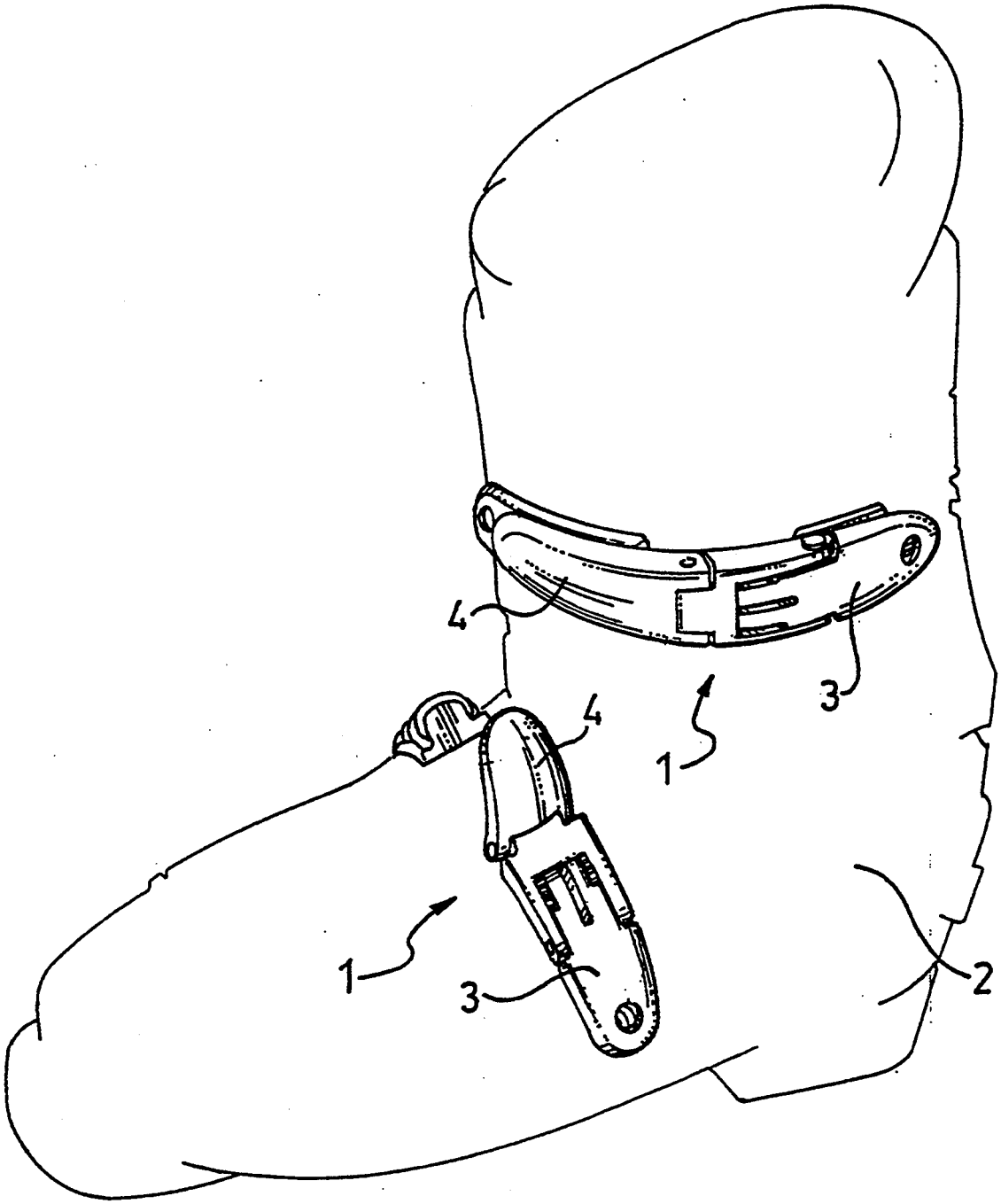

From a general point of view, the present invention relates to a fastening for sports footwear such as, for example, ski-boots and the like, and comprises a lever for tensioning a generally ring-shaped engagement element articulated thereto. In most cases, in order to achieve this articulation, the opposite end of the engagement element to its operative or functional end is articulated to the tensioning lever with an articulation axis parallel to the pivot axis of the lever itself.

As is well known, in order to fasten, for example, a ski boot, the operative end of the engagement element is engaged, with the lever open, in one of a plurality of corresponding engagement means, generally constituted by three or more sawtooth-like projections fixed to or otherwise formed on a support base, and the lever is then closed, tensioning the engagement element. In this case, the variability of the fastening tension is linked closely to the number, which is always moderate, of corresponding engagement means and to the spacing thereof.

In order to satisfy a widespread need for improved adjustability of the fastening tension to the needs of an individual user, the tensioning levers have for some time had adjustment devices, by means of which it is possible to change, even micrometrically, the length of the unit constituted by the tensioning lever and the engagement element. In practice and wholly schematically, for this purpose, the pin on which the engagement element can pivot is connected transversely to the threaded shank of a screw which is supported rotatably by the tensioning lever with a male-and-female screw connection and which can be operated directly by the user who can achieve the desired tensioning by trial and error.

Although adjustment devices of this type are very widespread and are also advantageous from some points of view, they have the disadvantage that the adjustment laboriously achieved is lost too easily since, when the fastening is unfastened, the engagement element may inadvertently be rotated and, with it, the male-and-female screw connection.

The main object of the present invention is to devise and make available a fastening for sports footwear in general, such as, for example ski boots, which has a device for adjusting the fastening tension having structural and functional characteristics such as to overcome the problem mentioned above with reference to the prior art, without thereby being complex and expensive to produce and, what is more, without making the usual manipulations necessary for its operation more complicated.

This and other objects which will become clearer from the description below are achieved by a fastening of the type in question which has the characteristics defined in the following claims.

Figure 3:
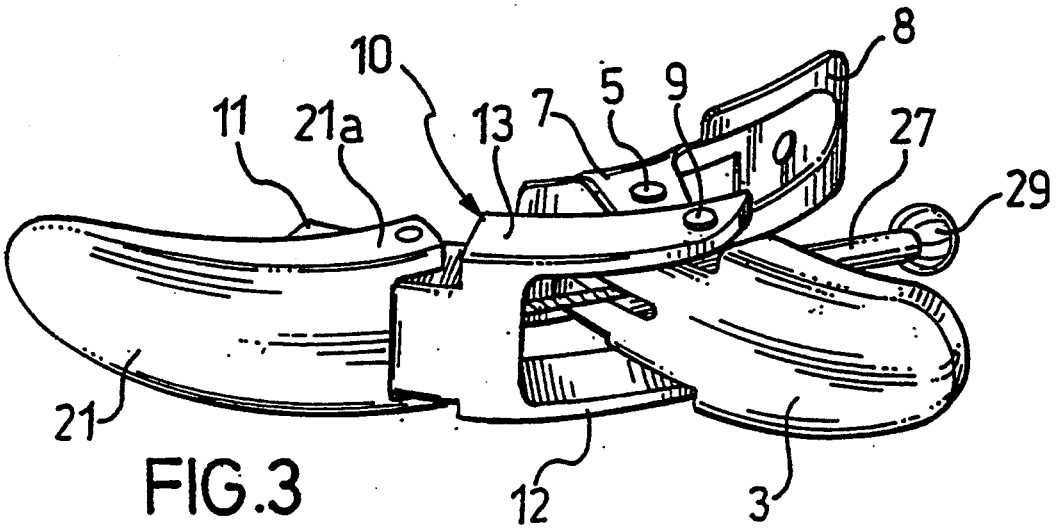
Figure 2:
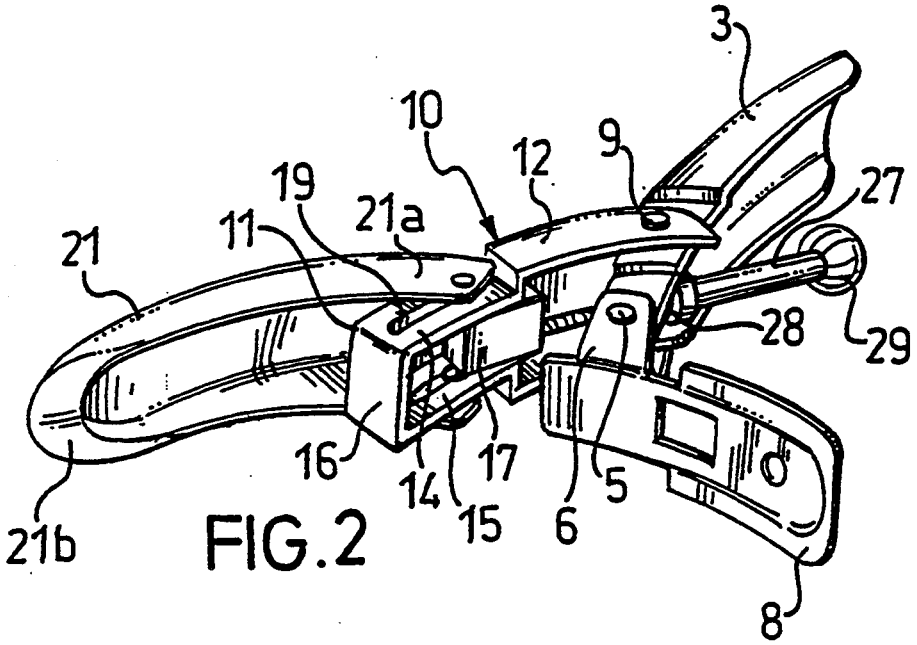
Figure 4:
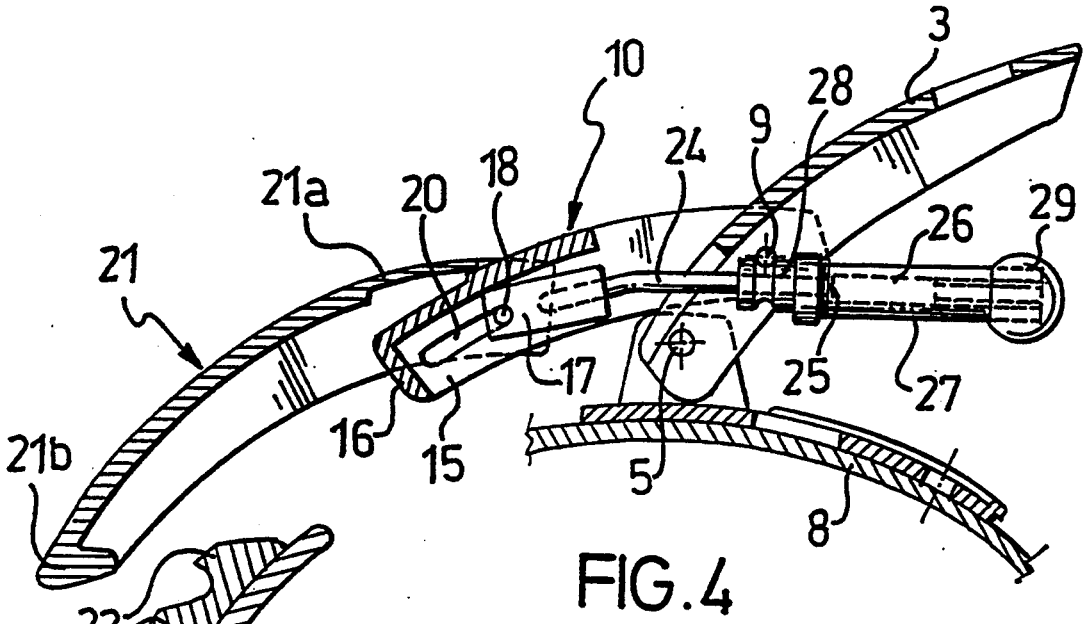
Figure 5:
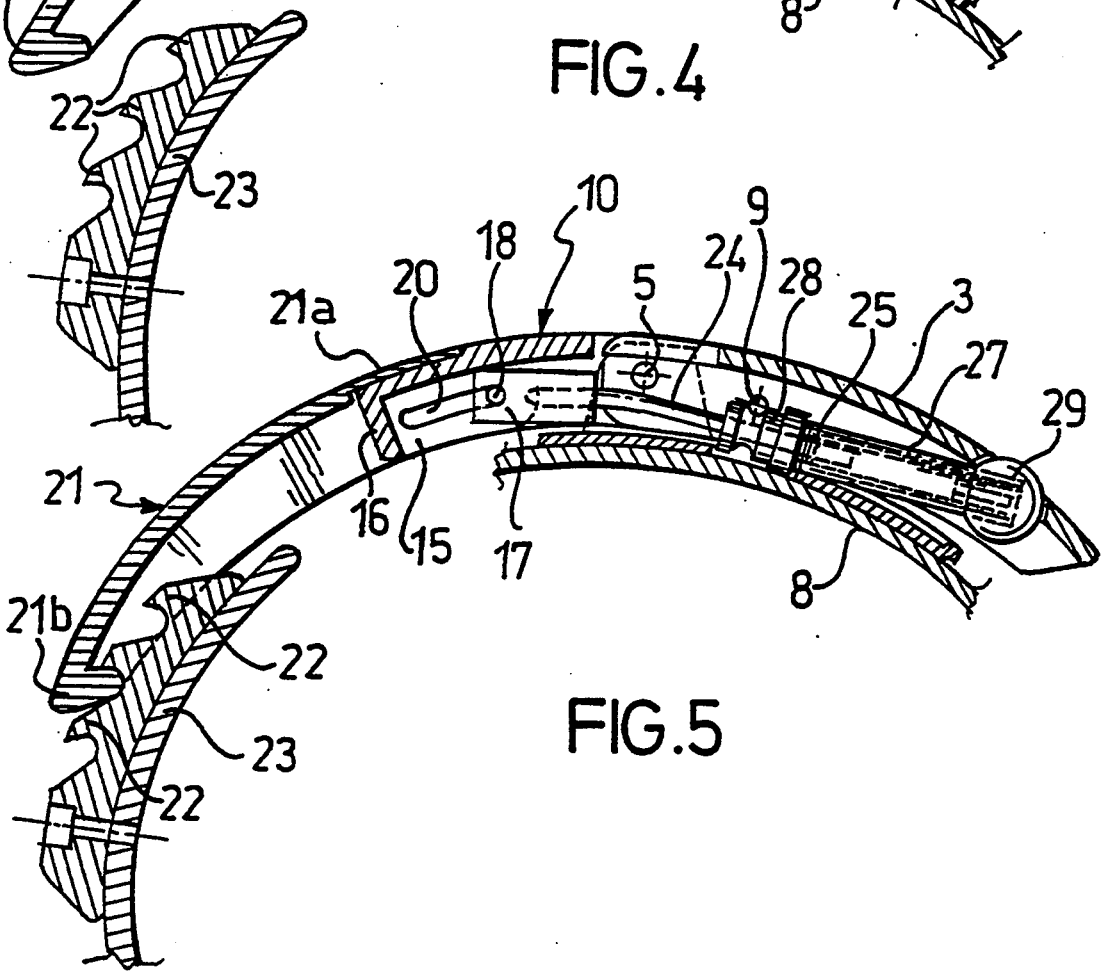

The characteristics and advantages of the fastening of the invention will become clearer from the following description of an embodiment thereof given by way of non-limiting example with reference to the appended drawings, in which:

FIG. 1 shows in perspective and schematically a ski boot to which a pair of fastenings according to the invention, shown in the fastened and unfastened conditions, respectively, are fitted, FIGS. 2 and 3 show a fastening according to the invention in the unfastened condition, seen from below and from above, respectively, on an enlarged scale, FIGS. 4 and 5 show the same fastening of the invention in the unfastened condition and in the fastened condition, on an enlarged scale and in longitudinal section.

With reference to the drawings, a fastening according to the invention for a ski boot 2 is generally indicated 1 and is of the type comprising a tensioning lever 3 and an engagement element 4 which is articulated to the lever 3 as will become clear from the following description.

The lever 3 is a second order lever and one of its ends is pivotable on a pin 5 carried by facing flanges 6 and 7 projecting from a plate-shaped support base 8.

A second pin 9 parallel to the pin 5 is supported by the lever 3 in an intermediate position thereof and has end portions projecting laterally from the lever.

A tension element shaped essentially like a tuning fork, associated and substantially in alignment with the lever 3, is generally indicated 20, its shank portion is indicated 11 and its identical, facing prongs are indicated 12 and 13.

The ends of the prongs 12, 13 are articulated on the pin 9 outside the lever 3.

In a preferred embodiment, the shank portion 11 of the tension element 10 has a substantially rectangular, box-like structure which is open towards the prongs 12, 13 and the facing long walls of which are indicated 14 and 15 and the short transverse wall is indicated 16 (FIG. 2).

A slide 17 guided for sliding between the walls 14, 15 supports a pin 18 parallel to the pins 5 and 9 mentioned above.

The pin 18 extends through longitudinal slots 19, 20 in the walls 14 and 15 of the tension element, respectively. The pin 18 can slide freely along the slots 19, 20.

The forked end **21*a* of an engagement element, generally indicated 21 is mounted pivotably on opposite end portions of the pin 18 outside the tension element 10 and its other, operative end 21*b* is intended to engage one of a plurality of corresponding engagement means 22 carried by a base 23. The corresponding engagement means are constituted, in conventional manner, by protuberances projecting from the base 23** and having substantially saw-tooth-like profiles.

The end of a cable 24 is set into or otherwise fixed in the slide 17 and its other end is set into (or otherwise fixed to) a screw 25 engaged for screwing in a female screw 26 formed inside a cylindrical rod 27.

One end of the rod 27 bears freely against an abutment 28 fixed to the intermediate pin 9 of the lever 3 and its other end advantageously has an operating grip 29.

By rotating the rod 27, it is possible to move and micrometrically adjust the slide 17, its pin 18 and, with them, the engagement element 21. It is thus possible to adjust the fastening tension micrometrically.

The movements of the slide 17 are straight and are guided by the long walls 14, 15 of the tension element 10 and by the slots 19, 20. The engagement element 21 cannot pivot about its longitudinal axis when the lever is open and the male-and-female screw connection 25, 26 cannot therefore rotate accidentally (unintentionally). The adjustment previously achieved is consequently kept unchanged. It is as if it were memorised in the fastening-tension adjustment device which is the subject of the invention.

I claim:

1. A fastening for sports footwear, particularly for ski boots and the like, comprising a tensioning lever pivotable on a support base, and an engagement element which has an operative end and the other end of which is mounted pivotally on a pin associated with a tension element hinged on the lever and extending substantially in alignment therewith, wherein the pin is supported by a slide which is movable along guides extending longitudinally in the tension element, and including male-and-female means having a screw associated with the lever for moving the slide in the guides.

2. A fastening according to claim 1, wherein the tension element has a substantially box-like structure with facing long walls extending longitudinally thereof, the walls having the guides for the slide.

3. A fastening according to claim 2, wherein the guides are constituted by slots in the walls of the tension element, portions of the pin projecting from the opposite sides of the slide and being slidably engaged in the slots.

4. A fastening according to claim 1, wherein the male-and-female screw is connected directly to the slide by means of a cable having opposite ends fixed to or inset in the slide and the screw, respectively.

* * * * *